US005819675A

United States Patent [19]

French et al.

[11] Patent Number: 5,819,675

[45] Date of Patent: Oct. 13, 1998

[54] FINISHED CAP FRAME FOR EMBROIDERY OF LOGOS

[76] Inventors: Nick L. French, 571 Watson Rd., Erlanger, Ky. 41018; Mark D. Mason, 6286 Lesourdsville Westchester Rd., Hamilton, Ohio 45011

[21] Appl. No.: 832,394

[22] Filed: Apr. 2, 1997

[51] Int. Cl.[6] ..... D05C 09/04

[52] U.S. Cl. ..... 112/103

[58] Field of Search ..... 112/103, 475.11, 112/975.18; 38/102.2; 72/397.2, 379.6

[56] References Cited

U.S. PATENT DOCUMENTS

| | | | |
|---|---|---|---|
| 3,421,355 | 1/1969 | Kramer | 72/379.2 X |
| 4,617,818 | 10/1986 | Fukuyori | 72/379.2 |
| 5,237,941 | 8/1993 | Kraft et al. | 38/102.2 X |
| 5,261,338 | 11/1993 | Tajima et al. | 112/103 |
| 5,507,241 | 4/1996 | Evans | 112/470.18 |
| 5,598,797 | 2/1997 | Patterson | 38/102.2 X |

OTHER PUBLICATIONS

Photographs of Tajima/Melco cap frame, of Tajima of Japan, believed to be prior art.

*Primary Examiner*—Ismael Izaguirre
*Attorney, Agent, or Firm*—Rhodes, Coats & Bennett, L.L.P.

[57] ABSTRACT

A frame for holding a cap of the type having a bill and a front crown. The frame includes an inner subframe having an inner band and an outer subframe having an outer band. The inner and outer bands are hingedly joined on one end so that the outer band may be selectively folded between an open position wherein the outer band is spaced from the inner band and a closed position wherein the outer band is disposed adjacent the inner band. Latch mechanisms are provided for selectively securing the outer band in the closed position. Spaced apart support arms extend upwardly from the inner band. Spaced apart clamp arms extend upwardly from the outer band. When the outer band is in the closed position, an outer opening defined between the clamp arms is disposed adjacent an inner opening defined by the support arms, and the clamp arms are disposed adjacent respective support arms for clamping portions of the crown of the cap therebetween. Each of the support arms includes a reinforcing rib integrally formed therein. A bill support platform is secured to and extends forwardly of the outer band and away from the inner band. At least one tooth is formed on a support arm and/or a clamp arm and extends toward the adjacent support arm or clamp arm when the outer band is in the closed position.

24 Claims, 3 Drawing Sheets

FINISHED CAP FRAME FOR EMBROIDERY OF LOGOS

FIELD OF THE INVENTION

The present invention relates to frames for holding finished caps for embroidering logos thereon, and, more particularly, to a frame for more securely and stationarily holding finished caps for embroidering logos thereon by means of mechanical embroidering equipment.

BACKGROUND OF THE INVENTION

In the conventional manufacture of caps (e.g., baseball caps) bearing embroidered logos on the front of the cap crown, each finished cap is mounted on a frame and the frame is mounted on or in an embroidery machine. The frame is intended to hold the front crown in place with minimal movement, stretch, or distortion during the embroidery operation.

An example of a conventionally available frame is the Tajima/Melco available from Tajima of Japan. The frame includes a rigid, arcuate rear subframe and a flexible front subframe. The subframes are connected at one end by a hinge so that they may be selectively folded into a closed position wherein the rear subframe is partially covered by the front subframe which bends to the arcuate shape of the rear subframe. The frame may be tightly secured in the closed position by a latch on the end opposite the hinge. The subframes each have a bottom cross band, a top cross band and a pair of spaced, vertical uprights extending between the crossbands. The uprights and crossbands together define an opening. The crossbands, uprights, and openings of the front and rear subframes are each in registry with the corresponding component of the other. In use, the crown of the cap is placed over the rear crossbands and uprights such that the portion of the cap to be embroidered overlies the opening, the cap brim extending forwardly. Notably, the top crossband of the rear subframe is disposed within the cap and thus at or near the area to be embroidered. The front subframe is clamped down into the closed, latched position, creating a frictional fit between the subframes and portions of the cap. Rubber may be positioned on the surfaces of the frame contacting the cap to enhance the frictional fit. Notably, the crossbands of the front subframe extend across the upper and lower parts of the crown, thereby reducing the sewable area.

The frame as just described suffers from several significant drawbacks in use. Because the top crossband of the rear subframe is positioned within the cap at or very near the area to be embroidered, the sewable area of the crown is limited. Also, the frame must be adjusted to accommodate caps of different crown heights. In addition to the inconvenience of effecting the adjustment, the provision of means for adjusting (e.g., a plurality of holes in the uprights, the uprights mounted to the bottom crossband by removable screws) generally adds to the complexity of the frame and the number of parts likely to become loose or misaligned in use. Also, even with rubber coatings, the frictional fit is often not sufficient to prevent displacement of the cap or relaxation of the desired stretch across the opening. Further, because no provision is made to support the cap's brim, there is a tendency for the brim to tilt downward, causing the crown to distort.

There exists a need for a frame for holding a cap for embroidery by an embroidery machine, such frame providing a more secure holding of the cap. In particular, the frame should more securely prevent displacement, relaxation, and distortion of the held cap. Further, there exists a need for a frame which does not unduly limit the sewable area of the cap's crown.

SUMMARY OF THE INVENTION

The present invention is directed to a frame for holding a cap of the type having a bill and a front crown. The frame includes an inner subframe and an outer subframe. The inner subframe has an arcuate inner band having first and second ends. First and second spaced apart support arms extend upwardly from the inner band, the support arms and the inner band defining an inner opening. A first hinge connector is formed on the first end of the inner band and a first latch mechanism is formed on the second end of the inner band. The outer subframe includes an arcuate outer band having first and second ends. A second hinge connector is formed on the first end of the outer band and is hingedly joined with the first hinge connector so that the outer band may be selectively folded about the hinge connectors between an open position wherein the outer band is spaced from the inner band and a closed position wherein the outer band is disposed adjacent the inner band. A second latch mechanism is formed on the second end of the outer band for selectively interlocking with the first latch mechanism for securing the outer band in the closed position. First and second spaced apart clamp arms extend upwardly from the outer band, the first and second clamp arms and the outer band together defining an outer opening. When the outer band is in the closed position, at least a portion of the outer opening is disposed adjacent at least a portion of the inner opening and the first and second clamp arms are disposed adjacent the first and second support arms, respectively, for clamping portions of the crown of the cap therebetween. Each of the first and second support arms includes a reinforcing rib integrally folded therein.

The present invention is further directed to a frame substantially as described above, except that it may or may not include the aforedescribed reinforcing rib, and further including a bill support platform secured to and extending forwardly of the outer band and away from the inner band. Preferably, the bill support platform includes an overhang portion extending rearwardly from the outer band and toward the inner band and arranged and configured such that, when the outer band is in the closed position, the overhang portion extends over the inner band.

The present invention is further directed to a frame substantially as described above, except that it may or may not include the aforedescribed reinforcing rib or the aforedescribed bill support platform, and further including at least one tooth formed on one of the first support arm and the first clamp arm and extending toward the other of the first support arm and the first clamp arm when the outer band is in the closed position. Preferably, at least one recess is formed in the other of the first support arm and the first clamp arm and is relatively arranged and configured to receive the at least one tooth. Preferably, a lip is formed on the other of the first support arm and the first clamp arm and extends toward the at least one of the first support arm and the first clamp arm. The lip is disposed adjacent the at least one tooth when the outer band is in the closed position.

In a preferred embodiment, the at least one tooth is formed on the first support arm and includes at least one second tooth formed on the second support arm and extending toward the second clamp arm when the outer band is in the closed position. More preferably, a plurality of the teeth are formed on at least one of the first and second support arms.

Each of the above described frames are preferably provided with certain additional features, as well. A handle may be secured to respective upper ends of each of the first and second clamp arms such that it extends therebetween. The inner and outer openings are preferably substantially coextensive. First and second bill receiving slots may be formed in the outer subframe proximate the first and second ends of the outer band and in communication with the outer opening. An endless ring may be secured to a lower edge of the inner band such that it depends therefrom. Preferably, the outer subframe is arranged and configured such that when the cap is mounted over the inner subframe and the outer subframe is in the closed position, no portion of the outer subframe extends across the front crown of the cap and between the clamp arms. Preferably, one of the inner and outer bands includes a projection extending therefrom and toward the other of the inner and outer bands when the outer band is in the closed position, and the other of the inner and outer bands includes an aperture therein. The aperture is relatively arranged, configured and positioned such that the projection is received by the aperture when the outer band is in the closed position.

The present invention and objects thereof will be appreciated by those of ordinary skill in the art from a reading of the figures and the detailed description of the preferred embodiment which follow, such description being merely illustrative of the present invention.

DETAILED DESCRIPTION OF THE PREFERRED EMBODIMENTS

Figure 2:
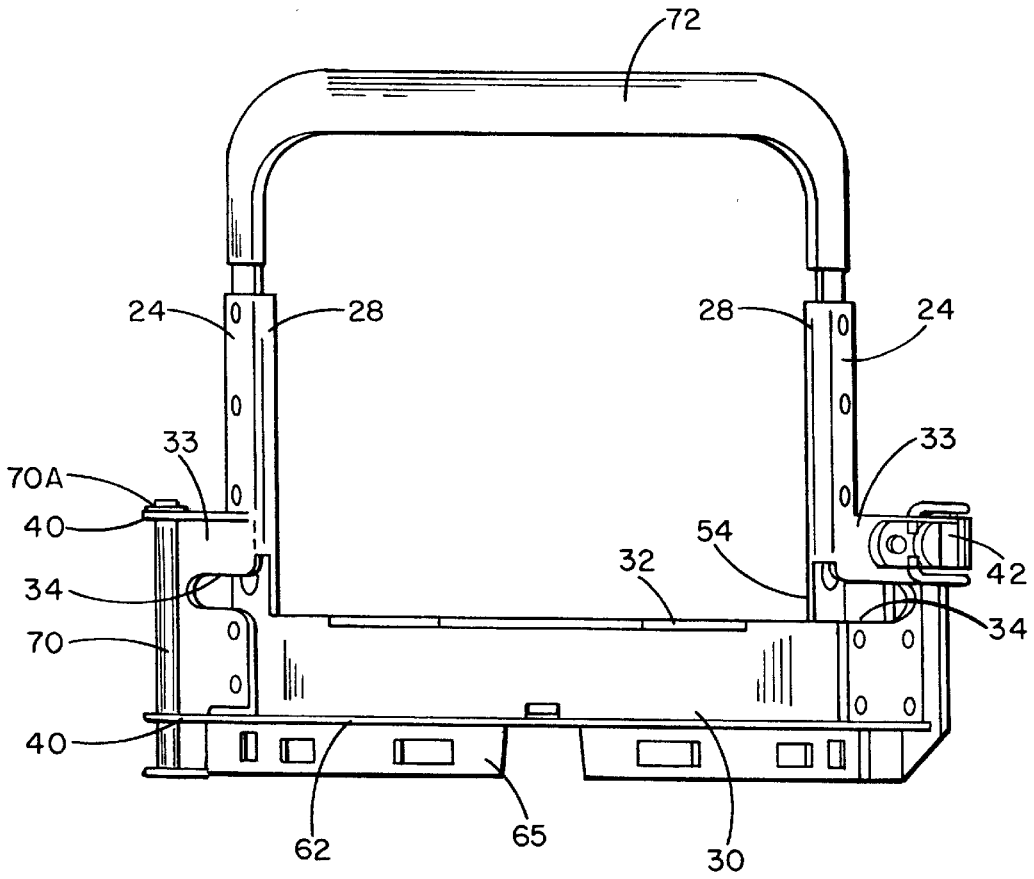
FIG. 2 is a front elevational view of the frame in a closed position.
Figure 3:
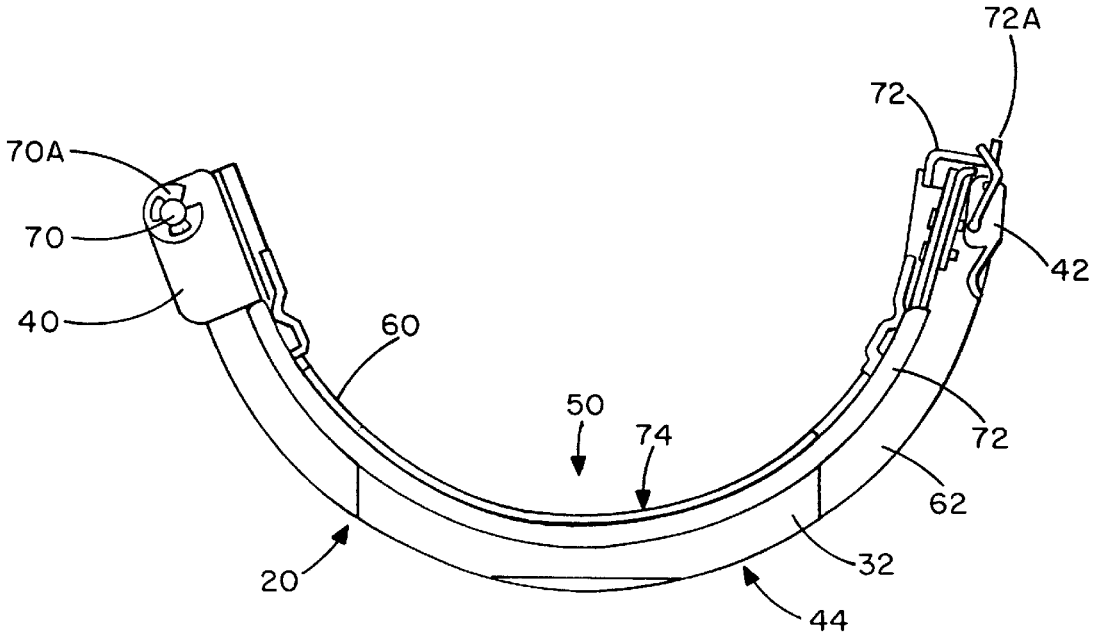
FIG. 3 is a top plan view of the frame in the closed position.
Figure 4:
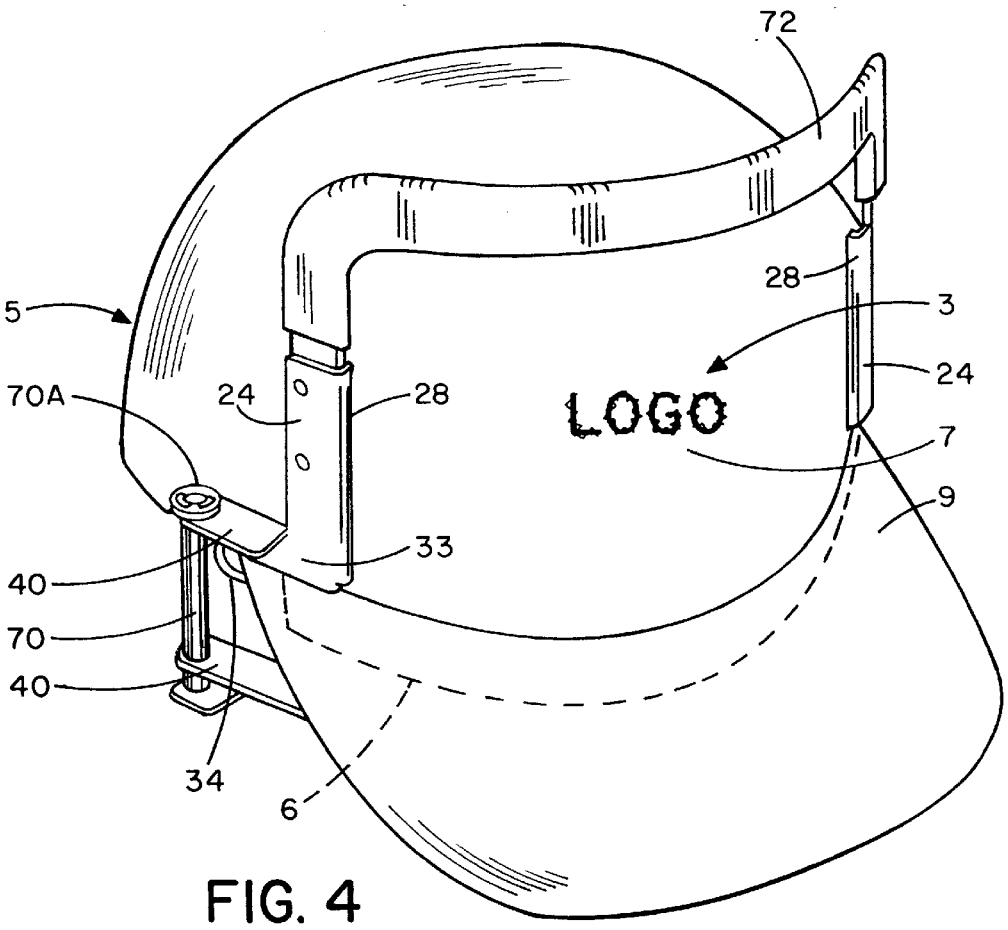
FIG. 4 is a left front, perspective view of the frame in the closed position and with a cap mounted therein.

With reference to the FIGS. 1–4, a frame 10 for holding a cap 5 for embroidering logos thereon is shown therein. Generally, frame 10 includes inner subframe 50 and outer subframe 20. As will be discussed in more detail below, and as shown in FIG. 4, cap 5 may be clamped in place on frame 10 such that displacement of the crown 7 of cap 5 relative to frame 10 is prevented, and moreover, crown 7 is held in a stretched condition to facilitate embroidering thereon. In this way, the proper location of the crown with respect to an embroidering machine onto which frame 10 is mounted is assured.

Turning to inner subframe 50 in more detail, inner subframe 50 has arcuate band 60 with support arms 54 extending upwardly therefrom on either end. Preferably, support arms 54 are integrally formed with band 60, and more preferably the band and support arms are metal stamped as a single piece. Band 60 has rim 62 extending forwardly therefrom. Aperture 66 is formed through band 60. Band 60 also has lower skirt 65 (FIG. 2). Vertical hinge pin 70 is secured to a first end of band 60. Upright 72 is secured to a second end of band 60 and has hook 72A formed thereon. The upper edge of band 60 and the inner edges of support arms 54 define an opening 74. Each support arm 54 has a reinforcing rib 58 extending along its vertical length. Also, each support arm 54 has a plurality of forwardly extending teeth 56 formed thereon, preferably along the edges adjacent opening 74 as shown.

Figures 1, 6:
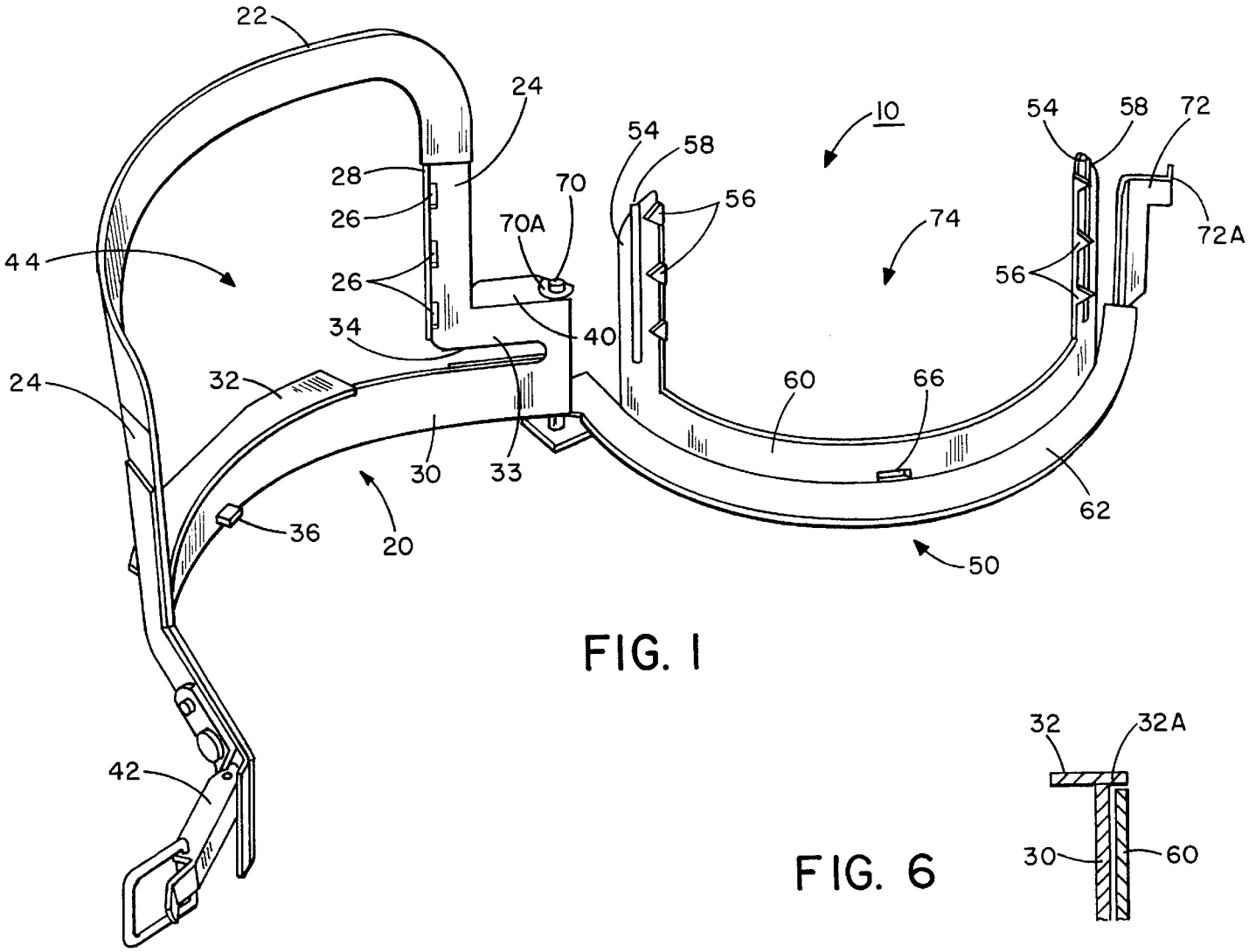
FIG. 1 is a perspective view of a frame according to the present invention in an open position.
FIG. 6 is a side, cross-sectional, schematic, fragmentary view of the inner and outer bands and the bill platform in the closed position.

Turning now to outer subframe 20 in more detail, outer subframe 20 has arcuate band 30 and clamp arms 24 extending upwardly therefrom. More particularly, band 30 has connector portions 33 with slots 34 defined therein. The inner edges of clamp arms 24 and the upper edge of band 30 together define opening 44. Hinge tabs 40 are formed on a first end of outer subframe 20 and are positioned about vertical hinge pin 70 and held in place by clip 70A to provide hinged movement between inner subframe 50 and outer subframe 20. Projection 36 is secured to the inner surface of band 30 and extends rearwardly. Projection 36 is sized and positioned such that when outer subframe 20 is placed in a closed position as shown in FIGS. 2, 3, and 4, projection 36 is received by and disposed in aperture 66 of band 60. Latch mechanism 42 is secured to a second end of outer subframe 20 and is arranged to pull outer subframe 20 tightly against inner subframe 50 when looped about hook 72A and placed in a locked position as shown in FIGS. 2, 3, and 4. In particular, when in the closed position, band 30 fits tightly against band 60. Each clamp arm has a plurality of recesses 26 formed therein. Recesses 26 are sized and positioned such that, when frame 10 is placed in the closed position, teeth 56 are received in corresponding recesses 26. Also, inwardly extending lips 28 are formed on each clamp arm 24 along the edges adjacent opening 44. Handle 22 is secured to (and preferably integrally formed with) the upper end of each clamp arm 24 and extends therebetween. Preferably, handle 22 is covered with rubber or other material to make it easier and more comfortable to grasp. Bill support platform 32 is secured to the upper edge of band 30 and extends forwardly therefrom. Furthermore, as best seen in FIG. 6, platform 32 has overhang portion 32A extending rearwardly of band 30. When the frame is in the closed position, portion 32A overlaps the upper edge of inner band 60 as shown. Overlap portion 32A preferably extends rearwardly about 3/16".

Each of the components as described above may be formed of steel or other suitable material. Further, the various components may be stamped, cast, or fabricated by any other suitable means. The various elements as separately formed may be welded, riveted or otherwise fastened together as appropriate. Preferably, each of the outer and inner subframes are unitary so that the only movable parts are latch 42 and hinge connectors 40, 70 and the only separable parts are the inner and outer subframes.

With reference to FIGS. 1 and 4, frame 10 according the present invention may be used in the following manner. First, frame 10 is placed in the open position as shown in FIG. 1 by releasing latch 42 and swinging outer subframe 20 about hinge connection 70, 40 and away from inner subframe 50. Cap 5 is placed over inner subframe 50 such that the crown surrounds support arms 54 and the rearmost portion of bill 90 is disposed along the upper edge of band 60. The sweat band 6 of the cap is pulled down about the front surface of band 60 so that it extends downwardly toward rim 62 and the inner surface of the sweatband lies against band 60. Outer subframe 20 is then swung toward the closed position such that bill 9 is received through opening 44 and slots 34. Frame 10 is then latched in the closed position by means of latch 42. In latching frame 10 in the closed position, the sweatband 6 of the cap is tightly sandwiched between the rearward surface of band 30 and the forward surface of band 60 and also between the lower surface of overhang portion 32A and the upper edge of band 60.

From the foregoing description, it will be appreciated that cap 5 when so mounted is securely held in place and in the desired shape for the embroidery of logo 3 into its crown 7. Support arms 54 serve to give crown 7 the appropriate shape for the embroidery operation. The combination of teeth 56, recesses 26, and lips 28 ensure that no movement occurs between the cap and the frame, and further that the crown 7 is held taut between support arms 54 and do not relax. The tight fit of bands 30 and 60 against the sweatband 6 of the cap prevents sliding of the cap relative to the frame. The tight fit of the upper edge of band 60 and overhang portion 32A against the sweatband, as well as the redirection of the sweatband as it wraps around the overhang portion, further secures the cap in place. Bill support platform 32 maintains the bill in an upright position to prevent distortion of the crown caused by flex or cantilevering of the bill. Ribs 58 minimize flex of support arms 54 which may otherwise compromise the effectiveness of the support arms in maintaining the shape of the crown.

The combination of projection 36 and aperture 66 prevents flex or relative displacement of subframes 20 and 50 so they are held in alignment during storage or handling to prevent damage which may affect their performance in use.

Notably, frame 10 as described above eliminates the need for front upper and lower bands positioned above the bill (i.e., in the front crown area) when in use. Accordingly, a larger sewing area is provided. The cap is securely held in registration both circumferentialy and radially, and essentially all slippage is prevented. Also, the features of the present invention provide an overall construction which is inherently durable and more convenient to use and handle. Frame 10 may be used for various styles of caps and a given size may be used for a wide range of crown heights. Further, the frame may be used for unconstructed caps (i.e., caps having no lining).

Figure 5:
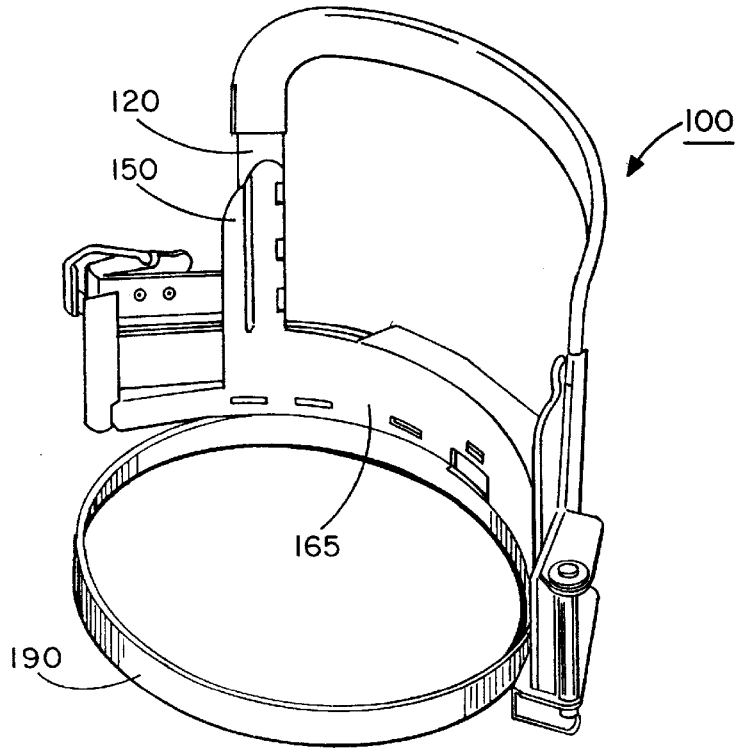
FIG. 5 is a rear, perspective view of a frame according to a second embodiment of the present invention in a closed position.

With reference to FIG. 5, a frame 100 according to a second embodiment of the present invention is shown therein. Frame 100 includes outer subframe 120 and inner subframe 150 corresponding in all respects to subframes 20 and 50 of the first embodiment, except as follows. Frame 100 has substantially rigid, endless ring 190 depending from the lower edge of skirt 165. Ring 190 may be welded in place or integrally formed with skirt 165. Ring 190 allows frame 100 to be used with Barudan embroidering machines.

While a preferred embodiment of the present invention has been described, it will be appreciated by those of skill in the art that certain modifications may be made without departing from the scope of the present invention. For example, the teeth 56 and recesses 26 may be reversed so that the teeth extend from the clamp arms and the recesses are formed in the support arms. All such modifications are intended to come within the scope of the claims which follow.

What is claimed is:

1. A frame for holding a cap of the type having a bill and a front crown, said frame comprising:

a) an inner subframe including:

i) an arcuate inner band having first and second ends;

ii) first and second spaced apart support arms extending upwardly from said inner band, said support arms and said inner band defining an inner opening;

iii) a first hinge connector formed on said first end of said inner band; and iv) a first latch mechanism formed on said second end of said inner band;

b) an outer subframe including:

i) an arcuate outer band having, first and second ends;

ii) a second hinge connector formed on said first end of said outer band and hingedly joined with said first hinge connector so that said outer band may be selectively folded about said hinge connectors between an open position wherein said outer band is spaced from said inner band and a closed position wherein said outer band is disposed adjacent said inner band;

iii) a second latch mechanism formed on said second end of said outer band for selectively interlocking with said first latch mechanism for securing said outer band in said closed position;

iv) first and second spaced apart clamp arms extending upwardly from said outer band, said first and second clamp arms and said outer band together defining an outer opening, wherein, when said outer band is in said closed position, at least a portion of said outer opening is disposed adjacent at least a portion of said inner opening and said first and second clamp arms are disposed adjacent said first and second support arms, respectively, for clamping portions of the crown of the cap therebetween; and c) a bill support platform secured to and extending forwardly of said outer band and away from said inner band.

2. The frame of claim 1 wherein said bill support platform includes an overhang portion extending rearwardly from said outer band and toward said inner band and arranged and configured such that, when said outer band is in said closed position, said overhang portion extends over said inner band.

3. The frame of claim 1 including a handle secured to respective upper ends of each of said first and second clamp arms and extending therebetween.

4. The frame of claim 1 wherein said inner and outer openings are substantially coextensive.

5. The frame of claim 1, including first and second bill receiving slots formed in said outer subframe proximate said first and second ends of said outer band and in communication with said outer opening.

6. The frame of claim 1, including an endless ring secured to and depending from a lower edge of said inner band.

7. The frame of claim 1, wherein said outer subframe is arranged and configured such that when the cap is mounted over said inner subframe and said outer subframe is in said closed position, no portion of said outer subframe extends across the front crown of the cap and between said clamp arms.

8. The frame of claim 1, wherein one of said inner and outer bands includes a projection extending therefrom and toward the other of said inner and outer bands when said outer band is in said closed position, and the other of said inner and outer bands includes an aperture therein, said aperture relatively arranged, configured and positioned such that said projection is received by said aperture when said outer band is in said closed position.

9. A frame for holding a cap of the type having a bill and a front crown, said frame comprising:

a) an inner subframe including:

i) an arcuate inner band having first and second ends;

ii) first and second spaced apart support arms extending upwardly from said inner band, said support arms and said inner band defining an inner opening;

iii) a first hinge connector formed on said first end of said inner band; and iv) a first latch mechanism formed on said second end of said inner band;

b) an outer subframe including:

i) an arcuate outer band having first and second ends;

ii) a second hinge connector formed on said first end of said outer band and hingedly joined with said first hinge connector so that said outer band may be selectively folded about said hinge connectors between an open position wherein said outer band is spaced from said inner band and a closed position wherein said outer band is disposed adjacent said inner band;

iii) a second latch mechanism formed on said second end of said outer band for selectively interlocking with said first latch mechanism for securing said outer band in said closed position;

iv) first and second spaced apart clamp arms extending upwardly from said outer band, said first and second clamp arms and said outer band together defining an outer opening, wherein, when said outer band is in said closed position, at least a portion of said outer opening is disposed adjacent at least a portion of said inner opening and said first and second clamp arms are disposed adjacent said first and second support arms, respectively, for clamping portions of the crown of the cap therebetween; and c) at least one tooth formed on one of said first support arm and said first clamp arm and extending toward the other of said first support arm and said first clamp arm when said outer band is in said closed position.

10. The frame of claim 9 wherein said at least one tooth is formed on said first support arm and including at least one second tooth formed on said second support arm and extending toward said second clamp arm when said outer band is in said closed position.

11. The frame of claim 10 including a plurality of said teeth formed on at least one of said first and second support arms.

12. The frame of claim 9 including at least one recess formed in the other of said first support arm and said first clamp arm relatively arranged and configured to receive said at least one tooth.

13. The frame of claim 9 including a lip formed on the other of said first support arm and said first clamp arm and extending toward said at least one of said first support arm and said first clamp arm, said lip disposed adjacent said at least one tooth when said outer band is in said closed position.

14. The frame of claim 9 including a handle secured to respective upper ends of each of said first and second clamp arms and extending therebetween.

15. The frame of claim 9 wherein said inner and outer openings are substantially coextensive.

16. The frame of claim 9 including a bill support platform secured to and extending forwardly of said outer band and away from said inner band.

17. The frame of claim 9 including first and second bill receiving slots formed in said outer subframe proximate said first and second ends of said outer band and in communication with said outer opening.

18. The frame of claim 9 including an endless ring secured to and depending from a lower edge of said inner band.

19. The frame of claim 9 wherein said outer subframe is arranged and configured such that when the cap is mounted over said inner subframe and said outer subframe is in said closed position, no portion of said outer subframe extends across the front crown of the cap and between said clamp arms.

20. The frame of claim 9 wherein one of said inner and outer bands includes a projection extending therefrom and toward the other of said inner and outer bands when said outer band is in said closed position, and the other of said inner and outer bands includes an aperture therein, said aperture relatively arranged, configured and positioned such that said projection is received by said aperture when said outer band is in said closed position.

21. A frame for holding a cap of the type having a bill and a front crown, said frame comprising:

a) an inner subframe including:

i) an arcuate inner band having first and second ends;

ii) first and second spaced apart support arms extending upwardly from said inner band, said support arms and said inner band defining an inner opening;

iii) a first hinge connector formed on said first end of said inner band; and iv) a first latch mechanism formed on said second end of said inner band;

b) all outer subframe including:

i) an arcuate outer band having first and second ends;

ii) a second hinge connector formed on said first end of said outer band and hingedly joined with said first hinge connector so that said outer band may be selectively folded about said hinge connectors between an open position wherein said outer band is spaced from said inner band and a closed position wherein said outer band is disposed adjacent said inner band;

iii) a second latch mechanism formed on said second end of said outer band for selectively interlocking with said first latch mechanism for securing said outer band in said closed position;

iv) first and second spaced apart clamp arms extending upwardly from said outer band, said first and second clamp arms and said outer band together defining an outer opening, wherein, when said outer band is in said closed position, at least a portion of said outer opening is disposed adjacent at least a portion of said inner opening and said first and second clamp arms are disposed adjacent said first and second support arms, respectively, for clamping portions of the crown of the cap therebetween; and v) first and second bill receiving slots formed in said outer subframe proximate said first and second ends of said outer band and in communication with said outer opening; and c) a reinforcing rib integrally formed in each of said first and second support arms;

d) a handle secured to respective upper ends of each of said first and second clamp arms and extending therebetween;

e) a bill support platform secured to and extending forwardly of said outer band and away from said inner band, said bill support platform including an overhang portion extending rearwardly from said outer band and toward said inner band and arranged and configured such that, when said outer band is in said closed position, said overhang portion extends over said inner band;

f) at least one tooth formed on one of said first support arm and said first clamp arm and extending toward the other of said first support arm and said first clamp arm when said outer band is in said closed position;

g) at least one recess formed in the other of said first support arm and said first clamp arm relatively arranged and configured to receive said at least one tooth; and h) wherein said outer subframe is arranged and configured such that when the cap is mounted over said inner subframe and said outer subframe is in said closed position, no portion of said outer subframe extends across the front crown of the cap and between said clamp arms.

22. The frame of claim 21 wherein said inner and outer openings are substantially coextensive.

23. The frame of claim 21 including an endless ring secured to and depending from a lower edge of said inner band.

24. The frame of claim 21 wherein one of said inner and outer bands includes a projection extending therefrom and toward the other of said inner and outer bands when said outer band is in said closed position, and the other of said inner and outer bands includes an aperture therein, said aperture relatively arranged, configured and positioned such that said projection is received by said aperture when said outer band is in said closed position.

* * * * *